United States Patent [19]

Hübsch et al.

[11] 4,027,592

[45] June 7, 1977

[54] PROPELLANT CHARGE IGNITER WITH STRIKER ELEMENT

[75] Inventors: Günter Hübsch, Kalchreuth; Hellmut Bendler, Stein; Rudolf Stahlmann, Furth; Heinz Gawlick, Vagen, all of Germany

[73] Assignee: Dynamit Nobel Aktiengesellschaft, Troisdorf, Germany

[22] Filed: Feb. 4, 1976

[21] Appl. No.: 655,219

[30] Foreign Application Priority Data

Feb. 6, 1975 Germany ..... 2504907

[52] U.S. Cl. ..... 102/70 R; 89/26; 102/45; 102/86.5

[51] Int. Cl.[2] ..... F42C 1/02

[58] Field of Search ..... 102/45, 44, 70 R, 86.5, 102/56, DIG. 1; 89/26

[56] References Cited

UNITED STATES PATENTS

| | | | |
|---|---|---|---|
| 831,947 | 9/1906 | Graeme et al. | 102/86.5 |
| 3,885,500 | 5/1975 | Bornand | 102/45 |

FOREIGN PATENTS OR APPLICATIONS

| | | | |
|---|---|---|---|
| 1,056,737 | 3/1954 | France | 102/86.5 |

*Primary Examiner*—David H. Brown
*Attorney, Agent, or Firm*—Craig & Antonelli

[57] ABSTRACT

The present invention relates to a propellant charge igniter having a striker element with a rearward cylindrical shank portion extending through the bottom piece of the propellant charge igniter, a forward headpiece following the shank portion and having an enlarged outer diameter with respect to the shank portion, the striker element resting on an annular shoulder formed in the bottom piece and being provided with an annular, separable collar held by means of a counter member extending over the headpiece.

23 Claims, 1 Drawing Figure

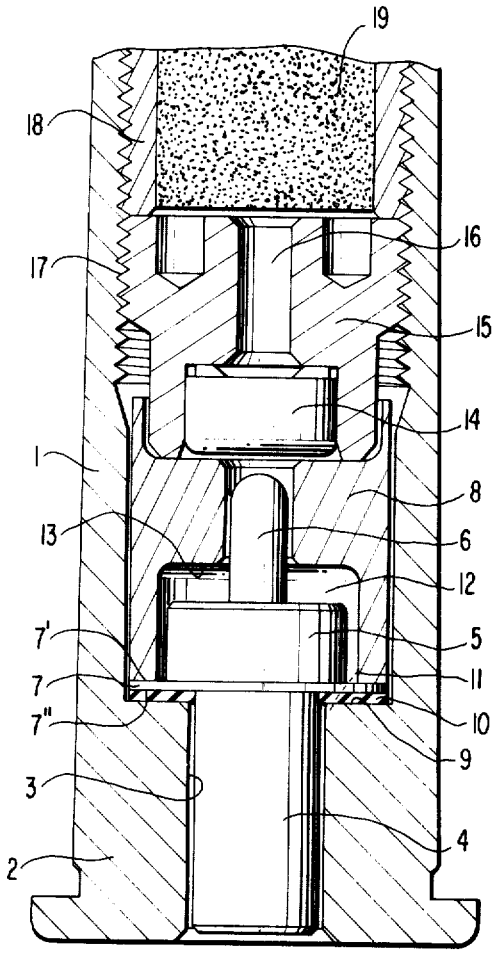
19
18
16
17
15
14
1
8
13
6
12
7'
5
7
11
7"
10
9
3
4
2

PROPELLANT CHARGE IGNITER WITH STRIKER ELEMENT

Propellant charge igniters are known for howitzers, cannons, mortars, or the like wherein the striker element at the rear end of the igniter member is essentially freely axially displaceable between a rearward position and a forward position in the igniter member, so that the striker pin of the striker element can strike the bottom of the primer element when the propellant charge igniter is subjected to vibrations, impact stresses, or the like. Although the primer element generally is not initiated by such actions, such actions may cause loosening of the primer charge such that ignition failures may be encountered. However, an unintended triggering is also possible, if the propellant charge igniter impinges on the ground, with its firing side, i.e., its front end, for example in falling tests. The handling safety of such propellant charge igniters thus is unsatisfactory.

Another substantial disadvantage of the known igniters is that fluid or water can enter practically unimpeded through the continuous bore in the bottom piece thereof which receives the rear shank of the striker element, thus seeping into the interior of the igniter. The required watertightness from the striker element side is absent in such igniters. Moreover, also the gastightness toward the bottom of the igniter is questionable, inasmuch as the striker pin of the striker element can penetrate to an almost unlimited extent into the cap bottom of the primer element and thus can perforate this bottom, so that in certain cases the likewise returning gases of the booster charge of the igniter or the gases of the propellant charge proper, to be ignited by the igniter, can unduly escape toward the rear through the igniter. Additionally, the primer element under the effect of the back pressure of the gases of the propellant charge is merely supported on the striker pin tip of the striker element.

The above-noted disadvantages are avoided, in part, in another conventional propellant charge igniter wherein the striker element is provided with a molding of a synthetic resin in the zone of its headpiece and having an outer diameter larger than the headpiece. The synthetic resin molding is arranged between the rearward cylindrical shank and the forward striker pin of the striker element and is fashioned in the forward zone similarly to a barrel-shaped sleeve. With the rearward end face of the synthetic resin molding, the striker element contacts an annular shoulder of the bottom piece of the igniter sleeve, while the striker element is supported by way of the forward end face on a counter member carrying the primer element, so that the striker pin of the striker element can be fixed at a predetermined spacing from the bottom of the primer element. The resistance against mechanical environmental stresses is thus provided. Additionally, a possible perforation of the primer element bottom can be prevented by dimensioning the free space above the barrel-shaped sleeve so that the striker element contacts with the forward end face of its headpiece the counter member before the striker pin of the striker element which is shifted axially forwardly in a corresponding manner has perforated the bottom of the primer element. Since during this step the primer element, under the back pressure of the propellant gases can furthermore be supported toward the rear on a corresponding, annular shoulder in the counter member, the gastightness toward the igniter bottom is provided.

However, a disadvantage of the aforementioned igniter arrangement is that the response sensitivity and the response insensitivity, representing after all a part of the handling safety and which must range within predetermined limits, are dependent on the crushing characteristic of the molded-on barrel-shaped sleeve. However, this characteristic is considerably altered in the temperature range from −40° to +50° C so that the safety requirement posed in this respect are not fulfilled. Also the watertightness of these igniters does not satisfy requirements in that the watertightness is dependent on the contact pressure exerted by way of the barrel-shaped sleeve on the headpiece of the striker element and presses the latter against the shoulder of the bottom piece. However, since the barrel-shaped sleeve must not have too high a rigidity, in view of the required response sensitivity of the igniter, the contact pressure which can be exerted by way of this sleeve is insufficient for ensuring the required watertightness.

A propellant charge igniter is also known wherein the striker element comprises a rearward cylindrical shank, a middle headpiece, and a forward cylindrical shank, the outer diameter of which is equal to that of the rearward shank, and wherein an annular, separable collar which is a shearing collar, is provided in the zone of the front end of the forward shank. The forward shank is furthermore provided toward the front with the striker pin proper contacting the primer element inserted in the counter member. The counter member extends over the striker element, including the headpiece, and is dimensioned so that the primer element contacts the striker pin and additionally an annular shoulder formed at the counter member contacts the shearing collar and the rearward annular end face of the counter member at the associated annular shoulder of the bottom piece, whereby the headpiece is pressed rearwardly against the shoulder of the bottom piece. Thus, a three-way fit is provided, so to speak, which can be maintained only at extremely small dimensional tolerances. However, in case of dimensional tolerances which normally occur during mass production, there may result an unfavorable minimum fit with the shearing collar being damaged or wholly sheared off during the assembly. In case of an unfavorable maximum fit, however, the striker element is no longer securely fixed between the bottom piece and the counter member. The resistance to environmental influences and the handling safety are thereby reduced and/or entirely missing. Additionally, the watertightness of this propellant charge igniter from the striker element side is present only to a limited extent since a prerequisite therefor is that the headpiece be pressed with sufficient force rearwardly against the associated shoulder of the bottom piece. However, this cannot be attained with reasonable expenditure under practical conditions, due to the aforementioned fitting difficulties. Also the gastightness toward the igniter bottom is doubtful, inasmuch as here again a perforation of the primer element bottom cannot be safely excluded, and the primer element is supported axially rearwardly only on the striker pin.

In these known propellant charge igniters, attempts have already been made to increase the watertightness by the introduction of a varnish between the igniter body and the striker element. The effectiveness of a varnish is, however, very questionable due to the great length of the required shelf life of, for example, ten years, inasmuch as disadvantageous changes due to aging, occurring during this time period, cannot be excluded with certainty. Besides, the penetration of the sealing varnish depends on gap sizes which are subject to the manufacturing tolerances, thus resulting in uncontrolled alterations of the response sensitivity and insensitivity. Thus, this procedure is likewise unsatisfactory under practical conditions.

It is therefore an object of the present invention to overcome the aforedescribed disadvantages in a propellant charge igniter of the type having a striker element with a rearward cylindrical shank portion extending through the bottom piece of the propellant charge igniter, a forward headpiece following the shank portion ahd having an enlarged outer diameter with respect to the shank portion, the striker element resting on an annular shoulder formed in the bottom piece and being provided with an annular, separable collar held by means of a counter member extending over the headpiece.

It is another object of the present invention to provide an igniter of the aforedescribed type having the required insensitivity to mechanical stresses, e.g., shockproofness, a flawless watertightness from the striker element side, whereby a predetermined response sensitivity and insensitivity are ensured.

In accordance with the present invention, the propellant charge igniter of the aforedescribed type is constructed such that the separable collar is a tear collar arranged at the headpiece and clamped in a form fitting manner by contacting at its forward end face the counter member which extends over the headpiece with radial play therebetween and by being supported at its rearward end face at a shoulder of the bottom piece. The striker element is, according to this feature, held in a defined manner within the propellant charge igniter exclusively by way of the fixedly clamped tear collar. In this construction, a desired small spacing is provided between the front end of the striker pin of the striker element and the bottom of the percussion-sensitive primer element, so that manufacturing tolerances cannot disadvantageously affect the fitting of the striker element. Additionally, the environmental stability and the handling safety are still further increased thereby. Preferably, such a spacing is also provided if a percussion primer element is inserted in the propellant charge igniter and accordingly the striker element is provided at its front end with a striker needle, wherein the ignition is then effected by the friction between the striker needle and the friction-sensitive primer charge.

By way of the counter member, extending over the striker element with the required spacings, which counter member is, for example, riveted or screwed into the propellant charge igniter, the contact pressure required for ensuring watertightness is exerted on the tear collar. That is, the tear collar is pressed to the desired extent against the shoulder of the bottom of the propellant charge igniter. By the selected strength for the tear collar, the impact energy can be controlled for the response sensitivity and insensitivity. This is so because the impact energy must first provide a proportion of its force for tearing off the collar and then, with exact separation, the residual energy becomes effective for affecting the primer element.

By the construction of the counter member, i.e., by controlling the axial distance between the forward end face of the headpiece of the striker element and the opposed abutment surface of the counter member, it is possible to prevent that, in case of a percussion-sensitive primer element, the primer element bottom is perforated by excessive energy of the striker pin in the weapon and correspondingly also of the striker pin of the propellant charge igniter. The spacing, in this connection, is selected to be of such a size that the head of the striker element abuts the counter member prior to the perforation of the bottom of the cap.

The striker pin of the striker element and accordingly also the continuous bore receiving the striker pin, which is provided in the counter member, is dimensioned with respect to the diameter so that, advantageously, this diameter is smaller than the outer diameter of the primer element, so that the latter can be supported rearwardly against the counter member. Another aspect which renders a reduction of this diameter advantageous is a perforation of the primer element bottom by the back pressure of the gases of the reacting propellant charge, since with a diminishing bore diameter the unsupported area of the cap bottom likewise becomes smaller and thus, with the same gas pressure, the effect of the force on this perforation-endangered zone is advantageously reduced.

In the conventional propellant charge igniter with shearing collar in the zone of the forward cylindrical shank, the separation of the collar, which is not clamped into position but rather contacts the counter member merely with an end face, cannot always be accomplished without resulting in a flange portion projecting laterally beyond the shank. Accordingly, depending on the radial clearance between the shank and the counter member encompassing the shank, there can occur an increased friction between the two components as a result of the projecting flange portion. As a result thereof, the values for the response sensitivity are undesirably altered. The same effect occurs to an even greater extent if the shearing collar is not actually separated but rather is only folded over in the rearward direction. These phenomena can be avoided in accordance with a feature of the present invention. The outer diameter of the headpiece and/or the shank at the forward end face of the tear collar is larger than at the rearward end face of the tear collar. In this connection, the tear collar, due to the notch effect between the forward end face of the fixedly clamped tear collar and the headpiece, tears off without leaving a burr or projection, starting with this annular edge, since it is clamped into position, on the one hand, and, on the other hand, finds no support in the zone of the forward ring edge at its rearward end face, due to the shoulder provided at that location. Inasmuch as the difference in diameter between the headpiece and the recess of the counter member extending thereover can be selected to be relatively large, i.e., with radial play, without a disadvantageous effect on the tearing-off procedure, as contrasted to the conventional propellant charge igniter, a frictionless movement of the striker element in the direction toward the primer element bottom is possible after the tear collar has been torn off, especially since also the inner diameter of the torn-off tear collar is larger than the outer diameter of the striker element part displaced toward the front by the tear collar.

According to another feature of the propellant charge igniter of the present invention the tear collar terminates flush with the rearward end face of the headpiece. To further increase the watertightness, with an unchanged contact pressure, according to a feature of the present invention an additional sealing element of, for example, lead, copper, natural rubber, a synthetic resin, such as, e.g., polyethylene or polypropylene, "Perbunan," or the like is arranged between the shoulder of the bottom piece and the rearward end face of the tear collar. According to a further feature, an advantageous fixation of the counter member in the propellant charge igniter is provided in that the counter member is pressed against the tear collar by means of a spacer member threadedly inserted in the sleeve of the propellant charge igniter, although the primer element can basically be arranged in the counter member, it is preferably accommodated in the spacer member which then acts simultaneously as the primer cap holder and can be threaded in each case with a predetermined torque into the propellant charge igniter.

These and other objects, features, and advantages of the present invention will become more apparent from the following description when taken in connection with the accompanying drawing which shows for the purposes of illustration only, a single FIGURE illustrating an embodiment of the propellant charge igniter in accordance with the present invention.

Referring now to the drawing, the single FIGURE shows the rearward end of a propellant charge igniter in a longitudinal section. The igniter includes a striker element, shown in an elevational view, comprising a rearward shank 4, a forward headpiece 5, a striker pin 6, as well as a tear collar 7 arranged in an outer sleeve 1 of brass integrally formed in this embodiment with a bottom piece 2 having a continuous bore 3. The striker element can be made, for example, of steel. However, preferably the striker element is produced from brass as are the remaining parts of the propellant charge igniter. A counter member 8 contacts with its rearward annular end face the forward end face 7' of the tear collar 7 and presses the latter with its rearward end face 7'' against a shoulder 9 of the bottom piece 2. The tear collar 7 does not contact the shoulder 9 directly, but rather indirectly, since a sealing ring 10 is additionally inserted between the two components. The tear collar 7, as shown, is constructed to terminate flush with the rear end face of the headpiece 5. The preferred tear-off direction of the tear collar 7 is indicated at the right rim of the headpiece 5 by the dashed line 11. As shown, the outer diameter of the headpiece 5 and/or the shank 4 at the forward end face 7' of the tear collar 7 is larger than that at the rearward end face 7''. Due to the construction, the tear collar tears off without leaving burrs or projections.

The counter member 8 has a rearwardly extending recess 12, with an internal diameter large enough so that the headpiece 5, when the tear collar 7 is torn off, can be displaced therein without any friction. The headpiece abuts an abutment surface 13 of the counter member 8 before the bottom of a primer element 14 has been perforated by the striker pin 6. The primer element 14 is inserted in a recess of the spacer member 15 having a flash bore 16, which spacer member is threadedly inserted in the sleeve 1 by way of the thread 17 and presses the counter member 8 with a predetermined force against the bottom piece 2. Above the spacer member 15, a booster charge 19 of the propellant charge igniter is arranged in an additional inner sleeve 18.

On the basis of the features of the present invention, the values for response sensitivity and response insensitivity can be maintained within narrow limits. Due to the fact that the tear collar 7 is connected by way of a projecting counter member 8 directly or by means of a sealing ring 10, placed thereunder, under tension with the propellant charge igniter body 1, 2, narrow tolerances are unnecessary with respect to the individual components. The watertightness is attained by an arbitrarily adjustble clamping of the tear collar and thus pressure contact with the bottom piece 2, preferably by way of the sealing ring 10.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A propellant charge igniter having a striker means including a rearward shank portion extending through a bottom piece of the propellant charge igniter, a forward headpiece connected with the shank portion and having an enlarged cross sectional dimension with respect to the shank portion, the striker element means being supported on a shoulder of the bottom piece and further including a separable collar member held by a counter member extending over the headpiece, the separable collar member being constructed as a tear collar member at the headpiece and having a forward and rearward end face, the tear collar member being clamped in a form-fitting manner by contacting at its forward end face the counter member extending over the headpiece and being supported at its rearward end face by the shoulder of the bottom piece.

2. A propellant charge igniter according to claim 1, wherein one of the headpiece and the shank portion are provided with a larger outer cross sectional dimension at the forward end face of the tear collar member than at the rearward end face of the tear collar member.

3. A propellant charge igniter according to claim 2, wherein the tear collar member terminates flush with the rearward end face of the headpiece.

4. A propellant charge igniter according to claim 1, further comprising a sealing means disposed between the shoulder of the bottom piece and the rearward end face of the tear collar member.

5. A propellant charge igniter according to claim 4, wherein the sealing means is an annular sealing element.

6. A propellant charge igniter according to claim 1, wherein the propellant charge igniter is provided with a sleeve member, and further comprising a spacer member inserted in the sleeve member and disposed for biasing the counter member against the tear collar member.

7. A propellant charge igniter according to claim 6, wherein the spacer member is threadedly connected with the sleeve member and is arranged for receiving a primer element.

8. A propellant charge igniter according to claim 7, wherein the striker means includes a forward striker portion connected with the headpiece, the striker portion extending in a bore of the counter member for movement therein and proximate to an end face of the primer element disposed in a recess of the spacer member.

9. A propellant charge igniter according to claim 8, wherein the bore of the counter member has a cross sectional dimension smaller than the cross sectional dimension of the primer element.

10. A propellant charge igniter according to claim 9, wherein the spacer member is provided with a flash bore therethrough and the sleeve member is integral with the bottom piece.

11. A propellant charge igniter according to claim 1, wherein the shank portion and headpiece are cylindrical, the shoulder of the bottom piece and the tear collar member are annular, and the counter member extends over the headpiece with radial play therebetween.

12. A propellant charge igniter according to claim 11, wherein the counter member is provided with a recess for receiving the headpiece, the recess having an enlarged diameter with respect to the outer diameter of the headpiece.

13. A propellant charge igniter according to claim 12, wherein one of the headpiece and the shank portion are provided with a larger outer cross sectional dimension at the forward end face of the tear collar member than at the rearward end face of the tear collar member.

14. A propellant charge igniter according to claim 13, further comprising a sealing means disposed between the shoulder of the bottom piece and the rearward end face of the tear collar member.

15. A propellant charge igniter according to claim 13, wherein the propellant charge igniter is provided with a sleeve member, and further comprising a spacer member inserted in the sleeve member and disposed for biasing the counter member against the tear collar member.

16. A propellant charge igniter according to claim 13, wherein the tear collar member terminates flush with the rearward end face of the headpiece.

17. A propellant charge igniter according to claim 16, further comprising a sealing means disposed between the shoulder of the bottom piece and the rearward end face of the tear collar member.

18. A propellant charge igniter according to claim 17, wherein the sealing means is an annular sealing element.

19. A propellant charge igniter according to claim 18, wherein the propellant charge igniter is provided with a sleeve member, and further comprising a spacer member inserted in the sleeve member and disposed for biasing the counter member against the tear collar member.

20. A propellant charge igniter according to claim 19, wherein the spacer member is threadedly connected with the sleeve member and is arranged for receiving a primer element.

21. A propellant charge igniter according to claim 20, wherein the striker means includes a forward striker portion connected with the headpiece, the striker portion extending in a bore of the counter member for movement therein and proximate to an end face of the primer element disposed in a recess of the spacer member.

22. A propellant charge igniter according to claim 21, wherein the bore of the counter member has a cross sectional dimension smaller than the cross sectional dimension of the primer element.

23. A propellant charge igniter according to claim 22, wherein the spacer member is provided with a flash bore therethrough and the sleeve member is integral with the bottom piece.

* * * * *